US007938917B2

(12) United States Patent
Okamoto et al.

(10) Patent No.: US 7,938,917 B2
(45) Date of Patent: May 10, 2011

(54) METHOD FOR CONTROLLING COOLING OF STEEL SHEET

(75) Inventors: Riki Okamoto, Tokai (JP); Noriyuki Hishinuma, Tokai (JP); Hidenori Miyata, Tokai (JP); Hirokazu Taniguchi, Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 359 days.

(21) Appl. No.: 11/795,115

(22) PCT Filed: Dec. 8, 2005

(86) PCT No.: PCT/JP2005/022994

§ 371 (c)(1),
(2), (4) Date: Jul. 10, 2007

(87) PCT Pub. No.: WO2006/075473

PCT Pub. Date: Jul. 20, 2006

(65) Prior Publication Data

US 2008/0135137 A1 Jun. 12, 2008

(30) Foreign Application Priority Data

Jan. 11, 2005 (JP) ..... 2005-004041

(51) Int. Cl.
*C21D 8/00* (2006.01)
*G01K 11/00* (2006.01)

(52) U.S. Cl. ..... 148/505; 148/500; 148/508; 148/579; 148/602; 148/603; 148/651; 374/43

(58) Field of Classification Search ..... 148/500, 148/505, 503, 508, 579, 602, 603, 651; 374/43
See application file for complete search history.

(56) References Cited

U.S. PATENT DOCUMENTS

| | | | | |
|---|---|---|---|---|
| 5,147,474 | A * | 9/1992 | Tamehiro et al. | 148/320 |
| 6,544,354 | B1 * | 4/2003 | Kawano et al. | 148/320 |
| 6,679,626 | B2 * | 1/2004 | Gramckow et al. | 374/43 |
| 2004/0006998 | A1 * | 1/2004 | Franz et al. | 62/62 |

FOREIGN PATENT DOCUMENTS

| | | |
|---|---|---|
| CN | 1127168 | 7/1996 |
| GB | 692267 | 6/1953 |
| JP | 59-007414 | 1/1984 |

(Continued)

OTHER PUBLICATIONS

Masayoshi Suehiro et al, A Mathematical Model for Calculating Transformations of High-Carbon Steel during Cooling and Its Application to Hot-Rolling Mill, Current advances in materials and processes, 1999, vol. 12, No. 3, pp. 393-396.

(Continued)

*Primary Examiner* — Deborah Yee
(74) *Attorney, Agent, or Firm* — Kenyon & Kenyon LLP

(57) ABSTRACT

A method for controlling the cooling of a steel sheet characterized by controlling the end-of-cooling temperature in a cooling process from the $Ae_3$ or above temperature of the steel sheet, during which; preliminarily obtaining enthalpies (Hγ and Hα) of an austenite phase and ferrite phase respectively at some temperature, obtaining a gynamic enthalpy (Hsys) defined by formula (1) with an untransformed fraction (Xγ) of austenite in accordance with a target temperature pattern, predicting the temperature by using a gradient of this dynamic enthalpy with respect to temperature as a dynamic specific heat and controlling the cooling of the steel sheet:

$$Hsys=H\gamma(X\gamma)+H\alpha(1-X\gamma). \quad \text{formula (1)}$$

13 Claims, 5 Drawing Sheets

FOREIGN PATENT DOCUMENTS

| | | | |
|---|---|---|---|
| JP | 4-80324 | A | 3/1992 |
| JP | 04-274812 | | 9/1992 |
| JP | 7-32006 | | 2/1995 |
| JP | 07-214132 | | 8/1995 |
| JP | 08-103809 | | 4/1996 |
| JP | 09-267113 | | 10/1997 |
| JP | 2000-317513 | | 11/2000 |
| JP | 2004-130353 | A | 4/2004 |
| JP | 2004-290990 | A | 10/2004 |
| TW | 339363 | | 9/1998 |
| TW | 1222902 | | 11/2004 |
| WO | WO 2004/42480 | A1 | 5/2004 |

OTHER PUBLICATIONS

M. Suehiro, et al., "*Development of Mathematical Model for Predicting Transformation of High-Carbon Steel During Cooling on Runout Table and Its Application to On-line Temperature Control of Hot Strip Mill*," Nippon Steel Technical Reports 67: 49-56 (1995).

M. Suchiro, et al., "*Application of Mathematical Model for Predicting Microstructural Evolution of High Carbon Steels*," ISIJ International 32(3): 433-439 (1992).

M. Suehiro, et al., "*A Kinetic Model for Phase Transformations of Low Carbon Steels during Continuous Cooling*," Iron and Steel 73(8): 1026-1033 (1987).

* cited by examiner

METHOD FOR CONTROLLING COOLING OF STEEL SHEET

TECHNICAL FIELD

The present invention relates to a method of control of the temperature of a steel sheet in the cooling process of a process of production of steel sheet.

BACKGROUND ART

In the process of production of a steel sheet, in the hot-rolling process, the final rolled steel sheet was cooled to a predetermined temperature by a cooling system provided between the finish rolling mill and the coiler and then was coiled up by the coiler.

In the hot-rolling process of a steel sheet, the mode of cooling by this cooling system (for example, providing an air cooling zone for holding the sheet at an intermediate holding temperature in the middle of cooling, making the cooling stop temperature, the coiling temperature, etc.) is becoming an important factor in deciding the mechanical characteristics of steel sheet.

Further, in the case of a cold-rolled steel sheet, in the annealing process performed after the cold-rolling, the mode of cooling at the cooling system after holding at the heating furnace (cooling rate and cooling stop temperature) is also becoming an important factor in deciding the mechanical characteristics of steel sheet.

This cooling is controlled by operating water valves or gas valves of the cooling system to spray the surface of the steel sheet with water or a gas. In this case, the basic heat transfer equation based on the coefficient of heat transfer and specific heat is used and the sheet thickness, sheet width, pass rate, entry-side temperature, cooling stop target temperature, and other input data are processed to determine the number of valves to operate.

However, it is very difficult to precisely control the temperature pattern or the end-of-cooling temperature corresponding to the changes in input conditions for each coil and within a coil.

As a control method to improve the temperature precision, Japanese Patent Publication (A) No. 7-214132 reports a method of ON/OFF control of valves when the predicted temperature is deviated from. Further, Japanese Patent Publication (A) No. 59-7414 reports the technology of installing a measurement system of the temperature and amount of transformation during cooling and revising the cooling amount based on the actual value.

On the other hand, as technology which aims at improvement of the precision of the predicted temperature, Japanese Patent Publication (A) No. 9-267113 reports a control method which estimates the coefficient of heat transfer based on the actual values of the finishing temperature, intermediate temperature, coiling temperature, and the like, while Japanese Patent Publication (A) No. 2000-317513 reports a control method which estimates the coefficient of heat transfer in water cooling in a transition state to nucleate boiling and film boiling.

However, these all relate to the coefficient of heat transfer.

Further, on the other hand, the estimates of the amount of heat generated from materials are not sufficiently advanced. This also becomes a cause of a decrease of the precision of temperature prediction.

Japanese Patent Publication (A) No. 4-274812 reports a method which predicts the amount of transformation heat using a transformation fraction found from a transformation fraction measuring device attached to the cooling system, while Japanese Patent Publication (A) No. 8-103809 reports, similarly for a method of obtaining a grasp of the transformation heat, a method which uses a prediction model of the transformation process to predict the transformation fraction by computation and estimate the transformation heat.

However, with these methods, it is not possible to consider the dependency of the specific heat on the transformation fraction and it is not possible to accurately estimate the heat from a steel sheet.

In regard to this, in *Nippon Steel Tech. Rep.*, No. 67, (1995), 49 (M. Suehiro et al.) and *ISIJ Int.*, Vol. 32, No. 3, (1992), 433 (M. Suehiro et al.), in order to estimate the temperature dependency of specific heat in addition to the transformation heat, the specific heat of the ferrite phase divided into the specific heat of magnetic transformation and the specific heat without magnetic transformation and the effect of the transformation fraction on the specific heat of magnetic transformation is introduced.

However, this idea is predicated on dividing the specific heat by the transformation fraction, so the specific heat of the austenite phase is not considered. The precision of temperature prediction at the beginning of transformation and at the high temperature range ends up becoming lower and estimation of the specific heat of magnetic transformation is very difficult.

DISCLOSURE OF THE INVENTION

The present invention was made in order to solve the above conventional problems and provides a method for controlling cooling of a steel sheet characterized by controlling a end-of-cooling temperature in a cooling process from an $Ae_3$ or above temperature of the steel sheet during which using a dynamic specific heat to predict the temperature.

In the present invention, "dynamic enthalpy" differs from the value at the low cooling rate (or low rate of temperature rate), that is, under conditions infinitely close to the state of equilibrium, actually measured using a differential thermal analyzer etc. (for example, the value described in *Physical Constants of Some Commercial Steels at Elevated Temperatures* (1953), British Iron and Steel Research Association) and indicates the "enthalpy with strong cooling rate dependency" at a high cooling rate (10 to several 100° C./s) considered on a steel sheet production line.

Further, in the present invention, "dynamic specific heat" differs from the value at the low cooling rate (low rate of temperature rate), that is, the under conditions infinitely close to the state of equilibrium, actually measured using a differential thermal analyzer etc. (for example, the value described in *Physical Constants of Some Commercial Steels at Elevated Temperatures* (1953), British Iron and Steel Research Association) and indicates the "specific heat with strong cooling rate dependency" at a high cooling rate (10 to several 100° C./s) considered on a steel sheet production line.

The present inventors engaged in in-depth research on the dependency of specific heat on the transformation fraction in order to improve the precision of the temperature prediction model used when controlling the end-of-cooling temperature in the cooling process from the $Ae_3$ temperature or more.

As a result, they learned that with the cooling rate used in the actual process of production of steel sheet, a delay in transformation occurs, so the phase fraction differs greatly from the phase fraction in the equilibrium state and that, in the temperature prediction model used in steel sheet production, it is necessary to use not the value of the specific heat obtained from equilibrium experiments, but the dynamic specific heat which considers the delay of transformation.

Therefore, the inventors intensively studied the method of precisely finding the dynamic specific heat and as a result discovered that the idea of distributing the conventional transformation heat and magnetic transformation specific heat by the transformation fraction is limited in precision of computation and that if obtaining the dynamic enthalpy defined by formula (1) with the enthalpy and untransformed fraction of the austenite phase and the ferrite phase, defining its gradient as the dynamic specific heat, and applying this for the specific heat of the conventional temperature prediction model, high precision prediction of temperature in a short time becomes possible.

The inventors completed this invention based on this discovery.

The invention according to claim 1 made in order to solve the above problems is a method for controlling cooling of a steel sheet characterized by controlling the end-of-cooling temperature in a cooling process from the $Ae_3$ or above temperature of the steel sheet during which preliminarily obtaining enthalpies (Hγ and Hα) of an austenite phase and ferrite phase respectively at some temperatures, obtaining a dynamic enthalpy (Hsys) defined by formula (1) with an untransformed fraction (Xγ) of austenite in accordance with a target temperature pattern, and using a gradient of this dynamic enthalpy with respect to temperature as a dynamic specific heat to predict and controlling the temperature:

$$Hsys = H\gamma(X\gamma) + H\alpha(1 - X\gamma) \quad \text{formula (1)}$$

Further, the invention according to claim 2 is the above invention characterized in that the target temperature pattern is a cooling rate of 10° C./s to 300° C./s in a region of ⅓ or more.

The invention according to claim 3 is the above inventions characterized by using the values of pure iron as the enthalpies (Hγ and Hα) of the austenite phase and ferrite phase of the steel.

The invention according to claim 4 is the above inventions characterized by predicting the untransformed fraction (Xγ) by a transformation curve preliminarily obtained for ingredients of the steel and a target temperature pattern.

Further, the invention according to claim 5 is characterized by predicting the untransformed fraction (Xγ) using a transformation prediction model which simulates a transformation process of a material.

Further, the invention according to claim 6 is characterized by controlling an intermediate holding temperature and a coiling temperature in a cooling process after hot-rolling during which performing control by a temperature predicted using the aforementioned dynamic specific heat.

Furthermore, the invention according to claim 7 is characterized by controlling a end-of-cooling temperature by an annealing process after cold-rolling during performing control by a temperature predicted using the aforementioned dynamic specific heat.

The steel is characterized by containing, by mass %,

C: 0.30% or less,
Si: 2.0% or less,
Al: 2.0% or less
Mn: 0.1% to 5.0%,
P: 0.2% or less,
S: 0.0005% to 0.02%, and
N: 0.02% or less and having a balance of iron and unavoidable impurities.

Further, the above steel may contain one or more of

Ti: 0.01% to 0.20% and
Nb: 0.01% to 0.10% and further may contain one or more of

Ca, Mg, Zr, and a REM in an amount of 0.0005% to 0.02%.

Further, the above steel may contain one or more of

Cu: 0.04% to 1.4%,
Ni: 0.02% to 0.8%,
Mo: 0.02% to 0.5%,
V: 0.02% to 0.1%,
Cr: 0.02% to 1.0%, and
B: 0.0003% to 0.0010%.

Further, the steel may have mass % of C, Mn, Si, and Al satisfying the formula (2):

$$(C) + 0.2 \times (Mn) - 0.1 \times (Si + 2 \times Al) \geqq 0.15 \quad \text{formula (2)}$$

According to the present invention, when controlling the end-of-cooling temperature in a cooling process from the $Ae_3$ temperature of the steel sheet or less, by raising the precision of the temperature prediction model, it is possible to improve the control precision of the steel sheet temperature pattern and end-of-cooling temperature in the cooling and a steel sheet can be produced as targeted.

BEST MODE FOR CARRYING OUT THE INVENTION

Figure 1:
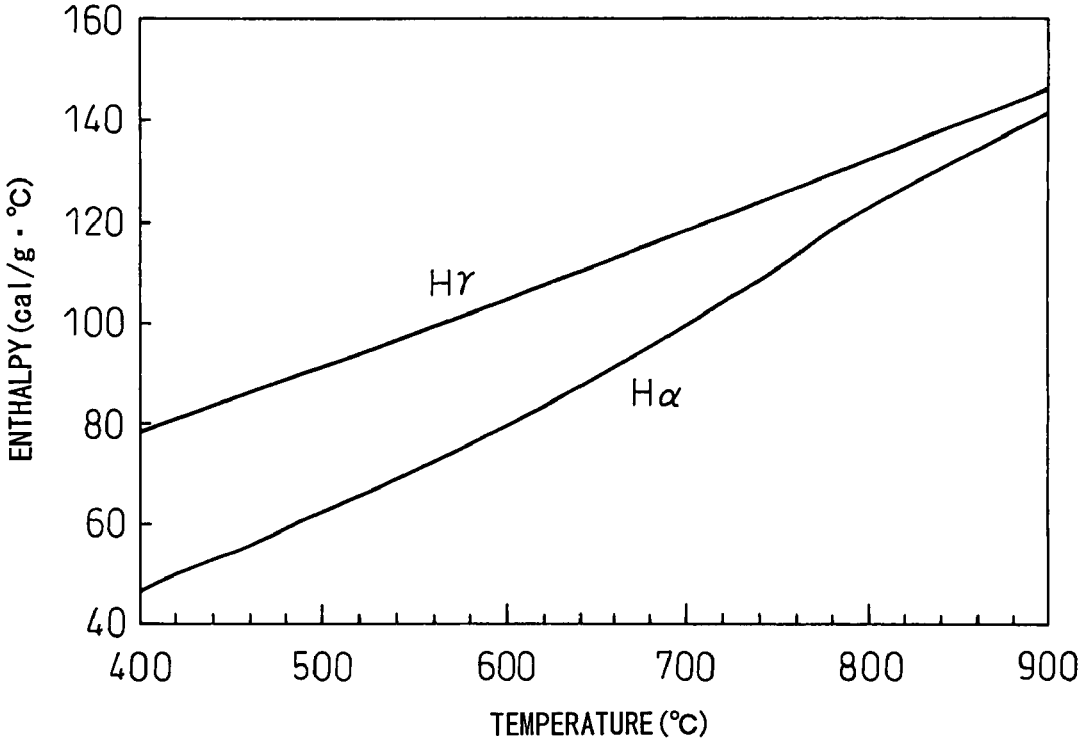
FIG. 1 is a view showing the enthalpies (Hα and Hγ) of the ferrite (α) phase and austenite (γ) phase in pure iron.
Figure 2:
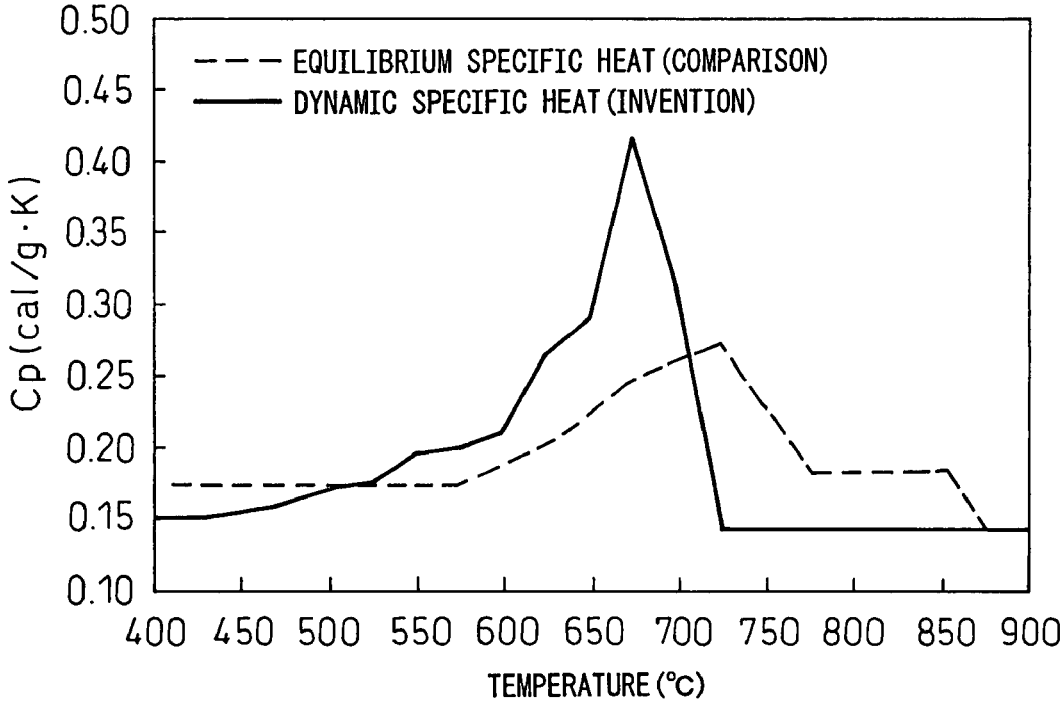
FIG. 2 is a view showing the conventional specific heat and the dynamic specific heat of a steel A.
Figure 3:
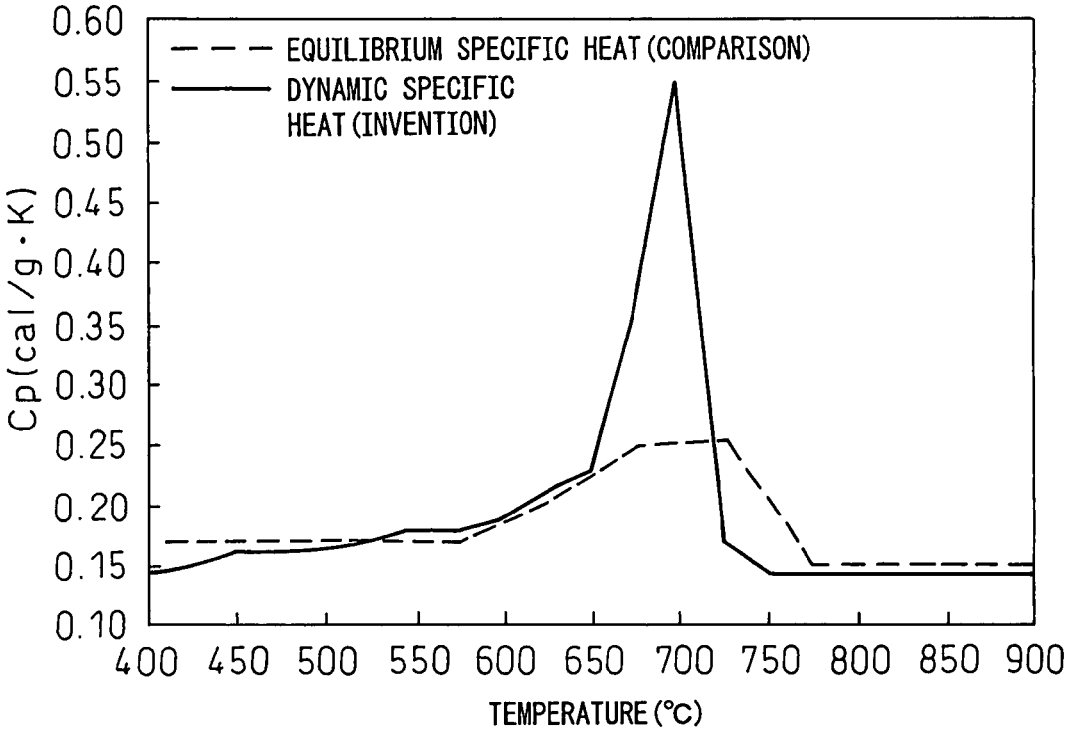
FIG. 3 is a view showing the conventional specific heat and the dynamic specific heat of a steel B.
Figure 4:
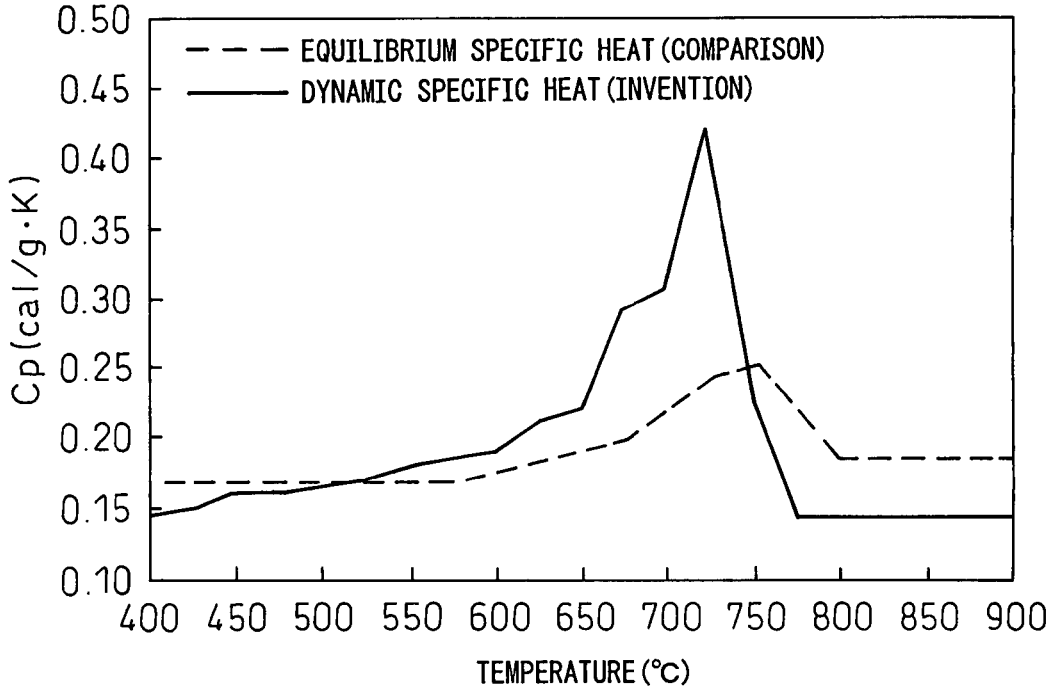
FIG. 4 is a view showing the conventional specific heat and the dynamic specific heat of a steel C.
Figure 5:
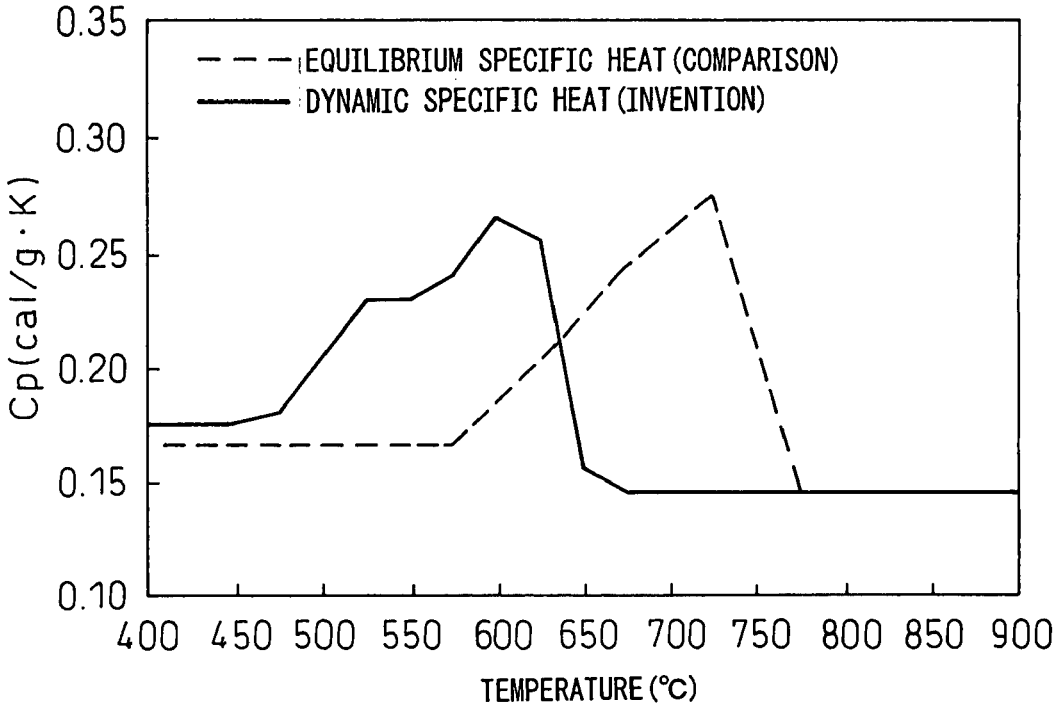
FIG. 5 is a view showing the conventional specific heat and the dynamic specific heat of a steel D.
Figure 6:
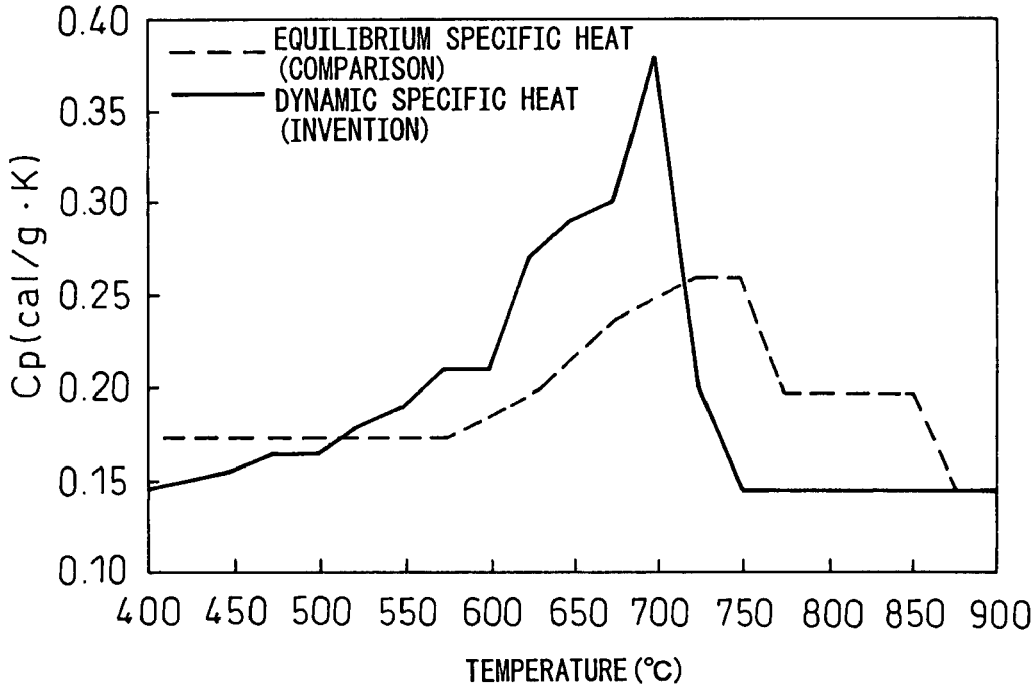
FIG. 6 is a view showing the conventional specific heat and the dynamic specific heat of a steel E.
Figure 7:
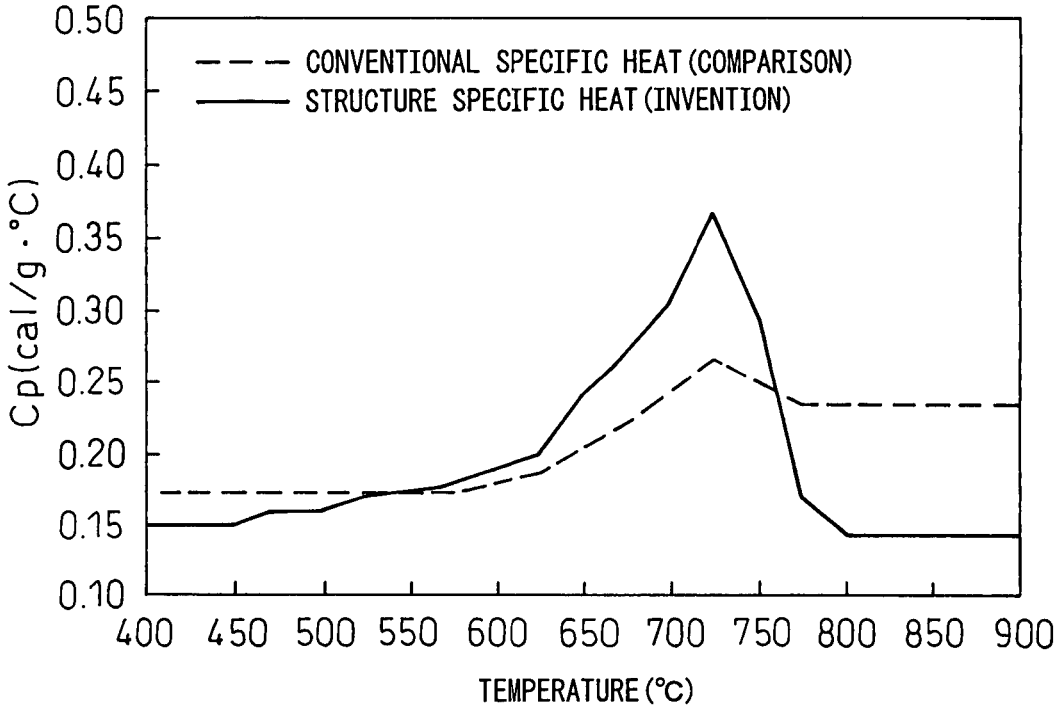
FIG. 7 is a view showing the conventional specific heat and the dynamic specific heat of a steel F.
Figure 8:
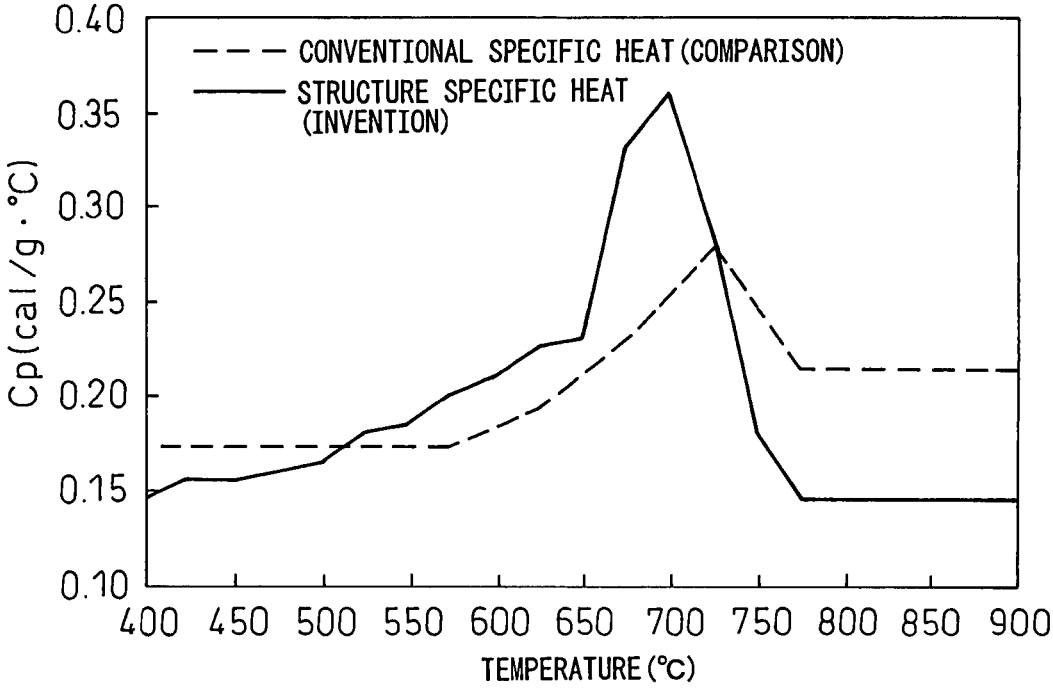
FIG. 8 is a view showing the conventional specific heat and the dynamic specific heat of a steel G.
Figure 9:
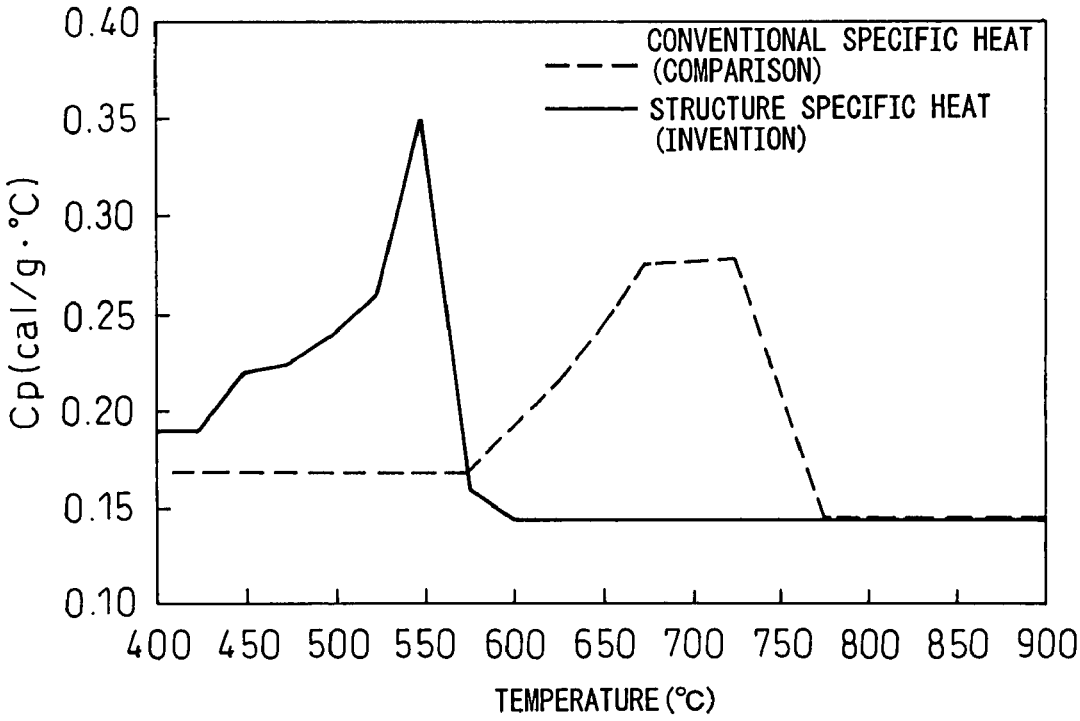
FIG. 9 is a view showing the conventional specific heat and the dynamic specific heat of a steel H.

The present invention controls the end-of-cooling temperature in a cooling process from the $Ae_3$ temperature or more during which it prepares a temperature prediction model corresponding to the delay of transformation due to the high cooling rate of the steel sheet production process, raises the temperature prediction precision, and achieves an improvement of precision of cooling control. Below, the individual constituent requirements of the present invention will be explained in detail.

The usual specific heat can be found by measuring the heat emission from the steel sheet corresponding to a drop in temperature under conditions close to equilibrium conditions where the cooling rate is very slow and differentiating the heat emission by the temperature, but under high cooling rate conditions, it is difficult to accurately measure the heat emission from the steel sheet by experiments, so it is impossible to find the specific heat under a high cooling rate (dynamic specific heat) by experiments.

The inventors engaged in in-depth studies of the method for precisely predicting the specific heat under a high cooling rate and as a result discovered that if using the calculation method shown below, it is possible to derive the specific heat under a high cooling rate (dynamic specific heat).

As a method to derive this dynamic specific heat, the inventors invented the technique of estimating the enthalpy of a mixed structure state in the middle of transformation where the transformation fraction dynamically changes by a high cooling rate as the dynamic enthalpy defined by formula (1) and defines the gradient of this dynamic enthalpy with regard to temperature as the dynamic specific heat.

At this time, the gradient of the dynamic enthalpy with regard to temperature may be found by differentiating the dynamic enthalpy by the temperature or by $\Delta Hsys/\Delta T$ using the change ($\Delta Hsys$) of dynamic enthalpy with regard to fine temperature changes ($\Delta T$).

However, if $\Delta T$ becomes too large, the dynamic specific heat at each temperature will end up greatly deviating from the actual heat and good precision temperature prediction will no longer be possible, so $\Delta T$ is preferably 50° C. or less.

The present invention in particular exhibits a great effect for conditions where the delay of transformation is great. For this reason, the present invention has a great effect of improvement of the temperature prediction precision in a target temperature pattern with a high cooling rate. In order to sufficiently obtain this effect, at the very least, a cooling rate of 10° C./s or more is necessary in a region of ⅓ of the target temperature pattern.

On the other hand, if the cooling rate is over 300° C./s, even if the temperature prediction is improved, the cooling controllability is not greatly improved due to the limit of the reaction rate in the cooling facility, so the upper limit of the cooling rate is made 300° C./s. In particular, in order to obtain a large effect, a cooling rate of 20° C./s or more is preferable.

Note that even if applying the present invention to a target temperature pattern where the region where the cooling rate is 10° C./s or less is ⅔ or more, the effect of improvement just becomes smaller. Never does it become inferior to the current prediction precision.

One of the most important aspects of the present invention is the method of deriving the dynamic enthalpy of the mixed structure in the middle of transformation.

The inventors engaged in repeated in-depth research and discovered that the dynamic enthalpy of a mixed structure in the middle of transformation can be estimated by weighted distribution of the individual enthalpies ($H\gamma$ and $H\alpha$) of the austenite phase and ferrite phase composing the mixed structure by the untransformed fraction ($X\gamma$) obtained by the target temperature history and derived formula (1):

$$Hsys = H\gamma(X\gamma) + H\alpha(1 - X\gamma) \quad \text{formula (1)}$$

One of the most important aspects of the present invention is the method of deriving the individual enthalpies of the austenite phase and ferrite phase used for the derivation of the above dynamic enthalpy.

The present inventors engaged in in-depth studies and as a result discovered that the temperature dependency of the enthalpy of the individual phases is not affected much at all by the components and further discovered that it is possible to derive a sufficiently high precision structure entropy by the enthalpies of the austenite phase and ferrite phase in pure iron.

Further, it is no longer necessary to calculate the individual entropies for each coil, so computation became possible at a high efficiency.

Further, for the individual enthalpies, it is possible to use ones found experimentally, for example, the values described in *Physical Constants of Some Commercial Steels at Elevated Temperatures* (1953), (British Iron and Steel Research Association), but for example it is also possible to use the results calculated by Thermo-Calc (B. Sundman: *Anales de fisica* 36*B*, (1990), p69) (FIG. 1).

At this time, in finding the enthalpies of the individual phases, even if not using the values of pure iron, using values obtained by certain specific ingredients so as to calculate the dynamic specific heats of various steels and various coils is not outside the scope of the present invention.

On the other hand, the transformation fraction with respect to the temperature pattern targeted may be calculated based on measured values actually measured by a transformation fraction measuring device attached to the line, but it is also possible to find the change in transformation fraction for ingredients and the target temperature pattern in advance by experiments etc., create a table for the ingredients and target temperature pattern, and use the same and also possible to create a mathematical formula having the ingredients and the target temperature pattern as functions and use the same.

Further, for prediction in advance, it is possible to use a transformation prediction calculation model able to predict a transformation structure for a temperature pattern at a high cooling rate. As this transformation prediction calculation model, for example it is possible to utilize the model described in Suehiro et al.: *Iron and Steel*, vol. 73, No. 8, (1987), 111.

The present invention is art considering the delay of transformation in cooling from the austenite phase to derive the dynamic specific heat and thereby improving the prediction precision of the temperature prediction model used for cooling control. So long as being cooling from the austenite phase, the cooling method may use a gas or water. Further, the invention can be applied to any of the processes of control of the intermediate holding temperature and coiling temperature in cooling after hot-rolling and control of the end-of-cooling temperature in the annealing process.

Next, the reasons for limiting the steel sheet ingredients in the present invention will be discussed.

C is an element having an effect on the workability of steel. If the content becomes great, the workability deteriorates. In particular, if over 0.30%, carbides (pearlite and cementite) harmful to hole expansion are formed, so the content is made 0.30% or less. Further, the greater the content of C, the greater the delay of transformation, so if using the conventional specific heat, the prediction precision of the temperature would drop and the effect of use of the dynamic specific heat would become larger.

Si is an element effective for suppressing the formation of harmful carbides, increasing the ferrite fraction, and improving the elongation and is an element effective for securing material strength by solution strengthening, so adding it is preferable, but if the amount added is increased, the chemical convertability drops and the point weldability deteriorates, so 2.0% is made the upper limit.

Further, the greater the content of Si, the smaller the delay of transformation, so even with the conventional specific heat, the prediction precision of the temperature becomes higher and the effect of use of the dynamic specific heat becomes smaller.

Al, like Si, is an element effective for suppressing the formation of harmful carbides, increasing the ferrite fraction, and improving the elongation. In particular, it is an element necessary for achieving both ductility and chemical convertability. Al is an element required for deoxidation in the past and has usually been added in an amount of 0.01 to 0.07%.

The inventors engaged in in-depth research and as a result discovered that by adding Al in a large amount in a low Si system, it is possible to improve the chemical convertability without causing degradation of the ductility.

However, if the amount added is increased, not only does the effect of improvement of the ductility end up becoming saturated, but also the chemical convertability falls and the point weldability also deteriorates, so 2.0% was made the upper limit. In particular, under the severe conditions of chemical conversion treatment, 1.0% is preferably made the upper limit.

Further, the greater the content of Al, the smaller the delay of transformation, so even with the conventional specific heat, the prediction precision of the temperature becomes higher and the effect of use of the dynamic specific heat becomes smaller.

Mn is an element necessary for securing strength. Even at a minimum, addition of 0.1% is necessary. However, if added in a large amount, micro-segregation and macro-segregation occur easily. These cause deterioration of the hole expansion ability. Therefore, 5.0% is made the upper limit. Further, the greater the content of Mn, the greater the delay of transformation, so if using the conventional specific heat, the prediction precision of the temperature would drop and the effect of use of the dynamic specific heat would become larger.

P is an element which raises the strength of the steel sheet and is an element which improves corrosion resistance by simultaneous addition with Cu, but if the amount added is high, it is an element which causes deterioration of weldability, workability, and toughness. Therefore, the content is made 0.2% or less. When corrosion resistance would not be a particular problem, workability is stressed and the content is preferably made 0.03% or less.

S is an element which forms sulfides such as MnS and the like, forms starting points of cracks, and decreases the hole expansion ability. Therefore, the content must be made 0.02% or less. However, if trying to adjust the content to less than 0.0005%, the desulfurization costs would become high, so S is set to 0.0005% or more.

N, if added in a large amount, causes the non-aging property to deteriorate, causes streak-like patterns called stretcher strain, and causes the workability to deteriorate and, in addition, impairs the appearance. If over 0.02%, this effect becomes remarkable, so N is made 0.02% or less.

Ti and Nb form carbides and are effective in increasing the strength. They contribute to greater uniformity of hardness and improve the hole expansion ability. In order to effectively achieve these effects, both for Nb and Ti, addition of at least 0.01% is necessary.

However, if addition of these elements becomes excessive, the precipitation strengthening causes the ductility to deteriorate, so the upper limit for Ti is 0.20% and for Nb is 0.10%. These elements are effective even if added alone and are effective even if added together.

Ca, Mg, Zr, and REMs control the shapes of the sulfide-based inclusions and are effective for improving the hole expansion ability. In order to effectively bring about this effect, it is necessary to add one or both in amounts of 0.0005% or more. On the other hand, addition of large amounts conversely causes the cleanliness of the steel to deteriorate and impairs the hole expansion ability and ductility. Therefore, the upper limits of Ca, Mg, Zr, and REM are made 0.02%.

Cu is an element improving the corrosion resistance by compound addition with P. In order to obtain this effect, addition of 0.04% or more is preferable. However, addition of a large amount increases hardenability and lowers the ductility, so the upper limit is made 1.4%.

Ni is an element essential for suppressing hot cracking when adding Cu. In order to obtain this effect, addition of 0.02% or more is preferable. However, addition of a large amount, like with Cu, increases hardenability and decreases ductility, so the upper limit is made 0.8%.

Mo is an element effective for suppressing the formation of cementite and improving the hole expansion ability. To obtain this effect, addition of 0.02% or more is necessary. However, Mo is also an element which increases hardenability, so excessive addition causes the ductility to drop. Therefore, the upper limit is made 0.5%.

V forms carbides and contributes to securing the strength. In order to obtain this effect, addition of 0.02% or more is necessary. However, addition of a large amount would reduce the elongation and raise the cost, so the upper limit is made 0.1%.

Cr also, like V, forms carbides and contributes to securing the strength. In order to obtain this effect, addition of 0.02% or more is necessary. However, Cr is an element which increases hardenability, so addition of a large amount would reduce the elongation. Therefore, the upper limit is made 1.0%.

B is an element effective for strengthening the grain boundaries and improving the resistance to secondary work cracking constituting a problem in super high tension steel. In order to attain this effect, addition of 0.0003% or more is necessary. However, B is also an element that increases hardenability, so addition of a large amount would reduce the elongation. Therefore, the upper limit is made 0.001%.

The present invention in particular exhibits a great effect for steels with a large delay of transformation. In steels meeting the conditions of the formula (2) set up using the mass % of C and Mn added in large amounts among the main added elements and, in particular, high in effect of delaying transformation and using the mass % of Si and Al which speed the transformation, the effect of improvement of the temperature prediction precision by use of the dynamic specific heat is large $$(C)+0.2\times(Mn)-0.1\times(Si+2\times Al)\geqq 0.15 \qquad \text{formula (2)}$$

EXAMPLES

Next, the present invention will be explained based on examples.

Table 1 shows the target ingredients of the steels A to H, while Table 2 shows the target finishing temperatures (FT), target coiling temperatures (CT), and average cooling rates (CR) in hot-rolling of these steels.

Further, the values of the steels derived from formula (2) are shown in Table 1. The equilibrium specific heat compared with is the specific heat of the substantially equilibrium state at the low cooling rate obtained by differential thermal analysis and the like.

On the other hand, the dynamic specific heat is found for the individual coils by using the entropy values (FIG. 1) of the ferrite phase and austenite phase of pure iron found by Thermo-Calc and, for the untransformed fraction ($X\gamma$) during cooling after hot-rolling, using the transformation prediction computation model of Suehiro et al.: *Iron and Steel*, vol. 73, No. 8, (1987), 111 and imputing the ingredient figures, FT figures, and cooling rate.

The dynamic enthalpy was calculated using formula (1) for the values of the temperatures obtained (calculation step ΔT=25° C.) and the drop (ΔHsys) of the enthalpy of each step was divided by the calculation step (ΔT=25° C.) to calculate the dynamic specific heat at each temperature.

As an example of calculation of the dynamic specific heat, the dynamic specific heat obtained under the conditions of Table 2 and the conventional specific heat obtained under conventional equilibrium conditions are compared and shown in FIGS. 2 to 9.

$$Hsys=H\gamma(X\gamma)+H\alpha(1-X\gamma) \quad \text{formula (1)}$$

Cooling control predicting temperature using this dynamic specific heat was performed for 20 to 100 coils of the steels A to E and the CT hit rate was measured. Here, the CT hit rate is the probability of the difference between the temperature predicted value of CT (CT predicted value) and the CT target value of Table 2 ((CT predicted value)−(CT target value)) when using the respective specific heats falling within ±30° C.

When using the dynamic specific heat of the present invention to predict the temperature, it is understood that a superior temperature prediction precision is obtained compared with the temperature prediction precision using the equilibrium specific heat.

Further, among these, the steels of A, D, G, and H (each 20 coils) were hot-rolled, then cold-rolled and annealed and then measured for the end-of-cooling temperature hit rate in the annealing process at that time.

Here, the end-of-cooling temperature hit rate is the probability of the difference between the temperature predicted value at the cooling end (cooling end predicted value) and the cooling end target value of Table 3 ((cooling end predicted value)−(cooling end target value)) when using the respective specific heats falling within ±30° C.

As shown in Table 3, when using the dynamic specific heat of the present invention to predict the temperature, it is understood that a superior temperature prediction precision is obtained compared with the temperature prediction precision using the equilibrium specific heat.

TABLE 1

| | C | Si | Mn | Al | P | S | N | Other | (mass %) Formula (2) |
|---|---|---|---|---|---|---|---|---|---|
| A | 0.10 | 0.10 | 1.00 | 0.030 | 0.011 | 0.0028 | 0.0043 | | 0.30 |
| B | 0.04 | 0.70 | 2.00 | 0.044 | 0.008 | 0.0020 | 0.0033 | Nb: 0.02 | 0.38 |
| C | 0.04 | 0.95 | 1.30 | 0.035 | 0.006 | 0.0010 | 0.0040 | Ti: 0.12, Ca: 0.002 | 0.21 |
| D | 0.13 | 1.00 | 2.30 | 0.048 | 0.006 | 0.0030 | 0.0050 | Ti: 0.03 | 0.59 |
| E | 0.15 | 0.02 | 0.50 | 0.045 | 0.008 | 0.003 | 0.0030 | | 0.26 |
| F | 0.05 | 0.02 | 0.25 | 0.040 | 0.011 | 0.003 | 0.0035 | Cu: 0.2, Ni: 0.1 | 0.10 |
| G | 0.10 | 0.015 | 0.40 | 0.035 | 0.009 | 0.003 | 0.0035 | Mo: 0.05 | 0.18 |
| H | 0.15 | 0.70 | 2.50 | 0.040 | 0.011 | 0.002 | 0.0040 | B: 0.0008 | 0.59 |

TABLE 2

| | | | | Dynamic rate (invention) | | Equilibrium specific heat (comparative) | |
|---|---|---|---|---|---|---|---|
| | FT ° C. | CT ° C. | CR ° C./s | CT hit rate | Number performed on | CT hit rate | Number performed on |
| A | 870 | 650 | 35 | 94% | 100 coils | 81% | 100 coils |
| B | 870 | 500 | 30 | 95% | 30 coils | 73% | 30 coils |
| C | 920 | 500 | 33 | 90% | 30 coils | 75% | 30 coils |
| D | 880 | 550 | 50 | 90% | 30 coils | 66% | 30 coils |
| E | 840 | 680 | 25 | 99% | 30 coils | 83% | 30 coils |
| F | 880 | 580 | 40 | 95% | 20 coils | 90% | 20 coils |
| G | 880 | 580 | 35 | 94% | 20 coils | 86% | 20 coils |
| H | 840 | 600 | 40 | 92% | 20 coils | 70% | 20 coils |

*The CT hit rate is the ratio by which (CT predicted value) − (CT target value) <±30° C.

TABLE 3

| | Annealing temperature ° C. | End-of-cooling temperature ° C. | CR ° C./s | Dynamic rate (invention) Cooling end hit rate | Dynamic rate (invention) Number performed on | Equilibrium specific heat (comparative) Cooling end hit rate | Equilibrium specific heat (comparative) Number performed on |
|---|---|---|---|---|---|---|---|
| A | 850 | 350 | 80 | 94% | 20 coil | 86% | 20 coil |
| D | 850 | 420 | 80 | 92% | 20 coil | 76% | 20 coil |
| G | 850 | 350 | 80 | 96% | 20 coil | 88% | 20 coil |
| H | 850 | 320 | 80 | 98% | 20 coil | 80% | 20 coil |

*The cooling end hit rate is the ratio by which (cooling end predicted value) − (cooling end target value) < ±30° C.

INDUSTRIAL APPLICABILITY

As explained above, according to the present invention, when controlling the end-of-cooling temperature in a cooling process from the $Ae_3$ temperature of the steel sheet or more, by raising the precision of the temperature prediction model, it becomes possible to improve the control precision of the steel sheet temperature pattern and end-of-cooling temperature in the cooling and to produce steel sheet as targeted.

Therefore, the present invention has a high applicability in the ferrous metal industry.

The invention claimed is:

1. A method for controlling cooling of a steel sheet characterized in that the steel sheet contains, by mass %, C: 0.30% or less, Si: 2.0% or less, Al: 2.0% or less Mn: 0.1% to 5.0%, P: 0.2% or less, S: 0.0005% to 0.02%, and N: 0.02% or less and a balance of iron and unavoidable impurities, and has mass % of C, Mn, Si, and Al satisfying formula (2);

the method characterized by controlling the end-of-cooling temperature in a cooling process from the $Ae_3$ or above temperature of the steel sheet, during which obtaining in advance enthalpies (Hγ and Hα) of an austenite phase and ferrite phase respectively at some temperatures, obtaining a dynamic enthalpy (Hsys) defined by formula (1) with an untransformed fraction (Xγ) of austenite as a function of temperature in accordance with a target temperature pattern, predicting the temperature by using a gradient of this dynamic enthalpy with respect to temperature as a dynamic specific heat, and controlling the cooling of the steel sheet:

$$Hsys = H\gamma(X\gamma) + H\alpha(1 - X\gamma) \quad \text{formula (1)}$$

$$(C) + 0.2\times(Mn) - 0.1\times(Si + 2\times Al) \geqq 0.15 \quad \text{formula (2)}$$

wherein the target temperature pattern contains a region of ⅓ or more thereof in which a cooling rate is 10° C./s to 300° C./s.

2. A method for controlling cooling of a steel sheet according to claim 1 characterized by using the value of pure iron as the enthalpies (Hγ and Hα) of the austenite phase and ferrite phase of the steel.

3. A method for controlling cooling of a steel sheet according to claim 1 characterized by predicting the untransformed fraction (Xγ) by a transformation curve obtained in advance for ingredients of the steel and the target temperature pattern.

4. A method for controlling cooling of a steel sheet according to claim 1 characterized by predicting the untransformed fraction (Xγ) using a transformation prediction model which simulates a transformation process of a material.

5. A method for controlling cooling of a steel sheet characterized by controlling an intermediate holding temperature and a coiling temperature in a cooling process after hot-rolling during which performing control by a temperature predicted using the dynamic specific heat described in claim 1.

6. A method for controlling cooling of a steel sheet characterized by controlling a end-of-cooling temperature by an annealing process after cold-rolling during performing control by a temperature predicted using the dynamic specific heat described in claim 1.

7. A method for controlling cooling of a steel sheet according to any one of claims 1 and 3 to 6 characterized in that the steel further contains, by mass %, one or more of Ti: 0.01% to 0.20% and Nb: 0.01% to 0.10%.

8. A method for controlling cooling of a steel sheet according to claim 7 characterized in that the steel further contains, by mass %, one or more of Ca, Mg, Zr, and a REM in an amount of 0.0005% to 0.02%.

9. A method for controlling cooling of a steel sheet according to claims 7 characterized in that the steel further contains, by mass %, one or more of Cu: 0.04% to 1.4%, Ni: 0.02% to 0.8%, Mo: 0.02% to 0.5%, V: 0.02% to 0.1%, Cr: 0.20% to 1.0%, and B: 0.0003% to 0.0010%.

10. A method for controlling cooling of a steel sheet according to claim 8 characterized in that the steel further contains, by mass %, one or more of Cu: 0.04% to 1.4%, Ni: 0.02% to 0.8%, Mo: 0.02% to 0.5%, V: 0.02% to 0.1%, Cr: 0.20% to 1.0%, and B: 0.0003% to 0.0010%.

11. A method for controlling cooling of a steel sheet according to claim 1 characterized in that the gradient of the dynamic enthalpy with respect to temperature is determined by differentiating the dynamic enthalpy by the temperature or by ΔHsys/ΔT, wherein ΔHsys is the change in dynamic enthalpy and ΔT is the change in temperature.

12. A method for controlling cooling of a steel sheet according to claim 11 characterized in that ΔT is 50° C. or less.

13. A method for controlling cooling of a steel sheet according to claim 1 characterized in that the untransformed fraction (Xγ) is calculated based on actual measured values on the cooling line using a transformation fraction measuring device.

* * * * *

UNITED STATES PATENT AND TRADEMARK OFFICE

CERTIFICATE OF CORRECTION

PATENT NO. : 7,938,917 B2
APPLICATION NO. : 11/795115
DATED : May 10, 2011
INVENTOR(S) : Riki Okamoto et al.

It is certified that error appears in the above-identified patent and that said Letters Patent is hereby corrected as shown below:

Column 12, line 7, change "claims 1 and 3 to 6" to -- claims 1 to 6 --;

Signed and Sealed this
Seventh Day of February, 2012

David J. Kappos

David J. Kappos
*Director of the United States Patent and Trademark Office*